US006826888B2

(12) United States Patent
Hendriks et al.

(10) Patent No.: US 6,826,888 B2
(45) Date of Patent: Dec. 7, 2004

(54) FORM-FILL-SEAL MACHINE

(75) Inventors: Peter Joseph Hendriks, Weert (NL); Wilhelmus Catharina Gerardus Maria Tax, Weert (NL); Joseph Johan Maria Van Rens, Weert (NL)

(73) Assignee: CFS Weert B.V., RV Weert (NL)

( * ) Notice: Subject to any disclaimer, the term of this patent is extended or adjusted under 35 U.S.C. 154(b) by 34 days.

(21) Appl. No.: 10/412,647

(22) Filed: Apr. 11, 2003

(65) Prior Publication Data

US 2003/0233811 A1 Dec. 25, 2003

(30) Foreign Application Priority Data

Apr. 18, 2002 (NL) ..... 1020421

(51) Int. Cl.[7] ..... B65B 61/18

(52) U.S. Cl. ..... 53/133.4; 53/139.2; 53/551; 53/389.4

(58) Field of Search ..... 53/133.4, 139.2, 53/551, 389.4; 156/66; 226/44; 242/417.2, 417.3; 493/213, 214, 927

(56) References Cited

U.S. PATENT DOCUMENTS 3,045,403 A * 7/1962 Mitchell ..... 53/389.4
3,612,430 A * 10/1971 Freeman ..... 242/417.2
4,360,137 A * 11/1982 Noe et al. ..... 226/24
4,603,800 A * 8/1986 Focke et al. ..... 242/417.2
4,604,848 A * 8/1986 Clostermeyer ..... 53/389.4
4,765,118 A * 8/1988 Akutsu et al. ..... 53/551
5,176,334 A * 1/1993 Dreschau et al. ..... 226/44
5,776,045 A 7/1998 Bodolay et al. ..... 493/215
5,823,933 A * 10/1998 Yeager ..... 493/213
6,003,582 A 12/1999 Blohowiak et al. ..... 156/567
6,098,369 A * 8/2000 Bodolay et al. ..... 53/133.4
6,117,060 A 9/2000 Bodolay ..... 493/213
6,662,843 B1 * 12/2003 Johnson ..... 156/160

* cited by examiner

*Primary Examiner*—John Sipos
(74) *Attorney, Agent, or Firm*—Ladas & Parry

(57) ABSTRACT

A form-fill-seal device for forming bags from a web-shaped foil material, filling them with products and subsequently sealing them, the device comprising a foil supply station having means for holding a roll of foil web, a form shoulder for transforming the foil web into a foil tube and a station placed between the supply station and the form shoulder for applying a zipper strip transverse to the foil web for each bag to be made, the foil web following a first transport track between the supply station and the application station and a second transport track between the application station and the form shoulder, respectively, the device comprising a driver for continuously driving the foil web, the device further comprising a buffer former for forming a buffer length of foil web, which buffer former comprises a first foil web diverter and a second foil diverter, which engage onto the first and second track of the foil web respectively, and are connected to each other for simultaneous but opposite movement by a buffer former driver towards the first track and away from the second track, respectively, and vice versa, while taking up and discharging, respectively, equal lengths of foil web.

12 Claims, 2 Drawing Sheets

FORM-FILL-SEAL MACHINE

BACKGROUND OF THE INVENTION

The invention relates to a form-fill-seal device for forming bags from a web-shaped foil material, filling them with products and subsequently sealing them, the foil web prior to being transformed on a form shoulder into a foil tube being provided with zipper strips for providing the bags to be made with a zipper sealing.

It is known with continuously running form-fill-seal machines, wherein the foil web is continuously driven—at a uniform speed or otherwise—by driving belts positioned at the location of the filling station, to apply the zipper strips at the foil web by means of a zipper strip application station placed on a carriage, which during the application of the zipper strip is moved along with the moving foil web. A drawback of this is that the movement of the heavy carriage generates forces due to which the course of the machine becomes unsteady and failures occur more easily. Moreover the moveable carriage seriously limits the operating speed of the machine.

In another device some improvement on this is offered in that downstream of the zipper strip application station a moveable turn roller has been provided, with which during the continuous passage of the foil web a buffer length can be formed, which during the application of the zipper strip (when the foil web in the track of the supply roll up to the turn roller is kept still) can be discharged in order for the operation of the form-fill-seal means downstream of the turn roller not having to be interrupted. During application of the zipper strip the supply roll for the foil web is kept still.

A drawback of this is that time and again the supply roll has to be put to a standstill and into motion again, as a result of which considerable forces are exerted on the foil web, which as a result has varying web tensions resulting in an inaccurate course of the foil web in the machine and possibly failures. Furthermore the drive of the foil web has to be adapted for forming the correct buffer length in between the moments of activation of the zipper strip application station.

It is an object of the invention to improve on this.

SUMMARY OF THE INVENTION

From one aspect the invention to that end provides a form-fill-seal device for forming bags from a web-shaped foil material, filling them with products and subsequently sealing them, the device comprising a foil supply station having means for holding a roll of foil web, a form shoulder for transforming the foil web into a foil tube and a station placed between the supply station and the form shoulder for applying a zipper strip transverse to the foil web for each bag to be made, the foil web following a first transport track between the supply station and the application station and a second transport track between the application station and the form shoulder, respectively, the device comprising means for continuously driving the foil web, the device further comprising means for forming a buffer length of foil web, which buffer means comprise first foil web diversion means and second foil web diversion means, which engage onto the first and second track of the foil web, respectively, and are connected to each other for simultaneous but opposite movement by buffer drive means towards the first track and away from the second track, respectively, and vice versa, while taking up and discharging, respectively, equal lengths of foil web.

Thus a buffer length can be formed and discharged on both sides of the application station, in such a relation that in the period between the arranging of two zipper strips, a buffer length of foil web is formed downstream of the application station which is equal to a buffer length formed upstream of the application station during the application of a zipper strip. As a result the foil web is able to keep on running at constant speed both downstream and upstream of the buffer device, while during the application of the zipper strip the foil web can be kept still at that location.

In a simple embodiment the first and second foil web diversion means have been adapted for performing opposite movements of equal length.

The first and second foil web diversion means have preferably been arranged on respective arms of a lever, the buffer drive means engaging on the lever for reciprocally tilting it about a tilting shaft. With such a lever, both lever arms being of equal length, buffer formation and discharge can take place in a failure-proof manner.

Preferably the lever has been fixedly arranged on the tilting shaft and the tilting shaft is driven preferably by a servo motor. The driving can thus take place directly an accurately, in which the movement cycle can be adjusted for a smooth motion of the lever.

The accuracy of the process is further increased when a foil web brake has been arranged between the first foil web diversion means and the application station for keeping the foil web still between the first and the second foil web diversion means during the operation of the application station.

BRIEF DESCRIPTION OF THE DRAWINGS

The invention will be elucidated on the basis of an exemplary embodiment shown in the attached drawings, in which.

DETAILED DESCRIPTION OF THE DRAWINGS

Figure 1:
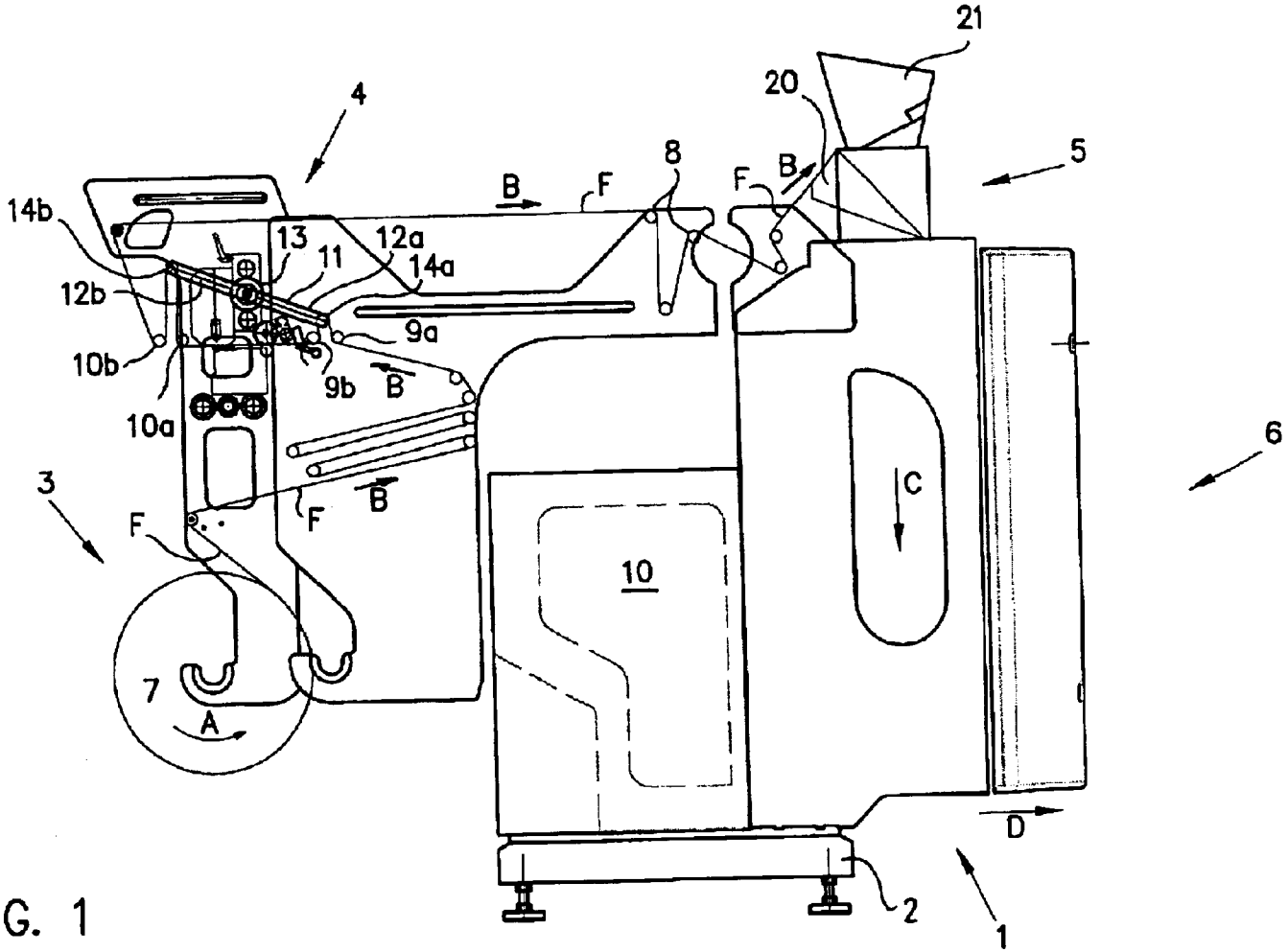
FIG. 1 shows a schematic front view of an exemplary embodiment of a form-fill-seal machine according to the invention, having a zipper strip application device and a buffer device according to the invention.

The form-fill-seal machine 1 shown in FIG. 1 is of the vertically operating type, although this is not essential to the invention: other machines operating in horizontal direction may also be suitable for the application of the invention.

The device 1 comprises a frame 2 wherein consecutively a supply station 3, a zipper strip application station 4, a forming station 5 and a filling/sealing station 6 have been arranged.

In the supply station 3 there is a supply roll 7 having foil web F rolled onto it, which roll is rotatable in the direction A.

Downstream of the supply roll 7 a number of turn rollers 8 have been arranged about which the foil web F is guided.

Figure 3:
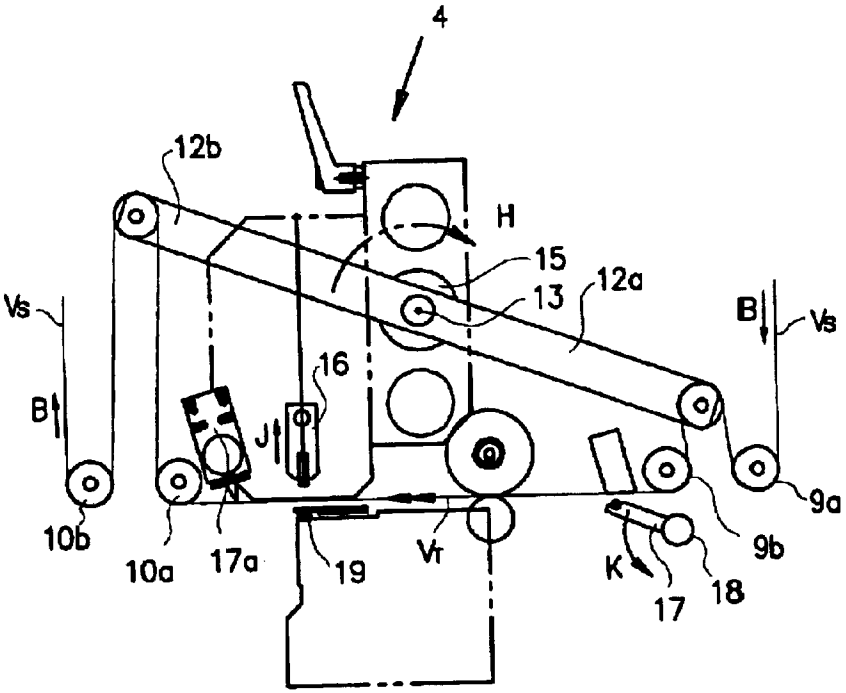
FIG. 3 shows the zipper strip application device with buffer device in the form-fill-seal machine of FIG. 1, during a moment between the application of zipper strips.
Figure 2:
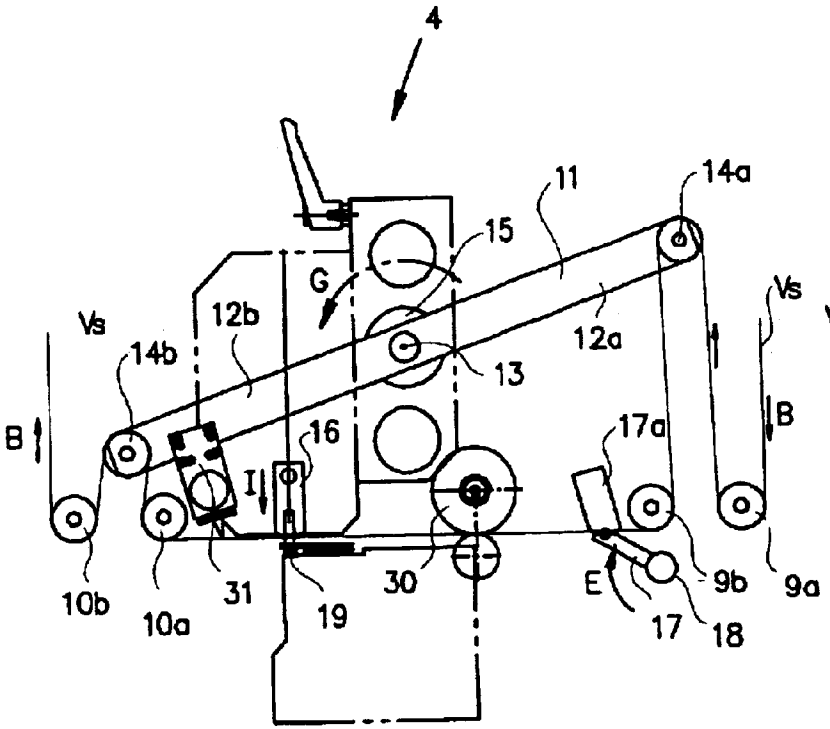
FIG. 2 shows the zipper strip application device and buffer device of the form-fill-seal machine of FIG. 1, during the application of a zipper strip.

In the zipper strip application station 4, as can be seen in FIGS. 2 and 3, a sealing head 16 has been arranged for a zipper strip supplied transverse to the plane of the drawing. For support of the zipper strip an anvil 19 has been provided which extends transverse to the foil web F.

Upstream of the sealing head 16 two turn rollers 9*a*, 9*b* have been arranged, and downstream of the sealing head 16 two turn rollers 10*a*, 10*b* have been arranged.

At the location of the zipper strip application station 4 a rigid lever 11 has also been arranged, which is tiltable about shaft 13, which is the exit shaft of, or is directly coupled to the exit shaft of a servo motor 15. The servo motor 15 is driven by control means that are not further shown, in opposite directions G and H, and can also be kept still, if so desired.

The lever 11 extends to either side with arms 12*a*, 12*b* of equal length, at the ends of which turn rollers 14*a*, 14*b* have been attached.

Between the sealing head 16 and the turn roller 9*b* a foil web brake 17 has been placed below the track for the foil web F, which foil web brake is hingeable about shaft 18, in the direction E or the opposite direction K. The operation of the brake 17 takes place by means of the control means in the device 1, adjusted to the control for the servo motor 15. There is an anvil 17*a* above the brake 17, for cooperation therewith.

Downstream of the sealing head 16 a photo cell 31 has been positioned, with which the moment of passage of usual marking spots on the foil web F, one spot for each bag to be made, can be detected. Between sealing head 16 and foil web brake 17 an encoder 30 has been positioned with which the passing web length per time unit can be determined. Both supply their data to the control unit 10 of the machine, in which also bag length and wanted location of the zipper strip in bag length direction (in relation to the location of the spot) have been entered. With the control unit, in which also the exact mutual position in web direction of the said components 16, 30 and 31 have been entered, the brake 17 can thus be operated in an exact and timely manner, so that the zipper strip is applied at the wanted location.

Downstream of the zipper strip application station 4 yet another number of turn rollers 8 have been arranged, via which the foil web F, moving in the direction B, arrives at a form shoulder 20, where the foil web is transformed from a flat shape into a tubular shape, which tube moves vertically downwards in the direction C. At the location of the forming station 5 there is also a feed funnel 21, for supply of products to be packaged, which, via a filling tube around which the tubular foil moves, fall into the bags that are still open at their upper side. In the known manner there is a sealing rod near the filling tube for sealing the foil with a longitudinal seal, and below the filling tube there are two pairs of transverse sealing rods having a blade in between them, for forming transverse seams in the bags.

At the filling tube driving belts known per se (not shown) have been arranged, which engage the foil tube for continuous passage of the tube and thus continuous supply of the foil web F, from the supply roll 7. It regards a continuously operative machine here, in which the said transverse sealing rod moves along vertically downwards during making the seal and the cutting through.

The formed and filled bags are discharged in the direction D.

For the operation of the buffer device FIGS. 2 and 3 are referred to. In the situation of FIG. 2 the sealing head 16 has been operated, and moved downwards in the direction I. Immediately prior to that the foil web brake 17 has been rotated in the direction E, in order to press the foil against the anvil 17*a*, and as a result stop the movement of the foil web there. A fixed point for the foil web has thus been formed there. The foil web will therefore also have been kept still at the location of the sealing head 16, as a result of which the application of a zipper strip and its subsequent securing on the foil web by means of a pre-seal can take place in an accurate and reliable manner.

As soon as the brake 17 has become effective, the servo motor 15 is controlled causing the lever 11 to tilt in the direction G. The turn roller 14*a* will then move upwards.

The drive of the servo motor 15 is such here that the foil web F turns about the turn roller 9*a* at an almost constant speed $V_S$, and therefore is also unrolled from the supply roll 7 at that speed. In this example the turn roller 14*a* will therefore be moved upwards at approximately a speed of half $V_S$.

Simultaneously the other arm 12*b* moves downwards to the same extent, the turn roller 14*b* also being moved downwards, at the same speed as the turn roller 14*a*, but then opposite. Because the foil web F is also at a standstill at the location of turn roller 10*a*, the foil web material is discharged at the same speed at which at the opposite side at the location of the turn roller 14*a* foil web material is taken up. The foil web F running away from the turn roller 10*b* can therefore move in the direction B at speed $V_S$. Said speed $V_S$ corresponds to the speed at which the driving belts positioned near the filling tube have been adjusted.

In FIG. 3 the situation in the (relatively longer) periods between the periods in which the zipper strips are applied is shown, wherein the foil web brake 17 has been pivoted away in the direction F of the foil web, and the lever 11 tilts in opposite direction H. Here the lever arm 12*b* will move upwards and the lever arm 12*a* downwards. The turn roller 14*a* thus moves downwards as well, and the turn roller 14*b* upwards. The foil web will permanently be pulled by the driving belts positioned near the filling tube, that means at a speed $V_S$, as a result of which the extra material needed in the loop which is formed between the turn roller 14*b* and the turn rollers 10*a*, 10*b* is supplied from the other, upstream side of the buffer, and namely from the stock loop which, as can be seen in FIG. 2, has been formed between the turn rollers 9*a*, 9*b* and 14*a*. The speed of the foil web downstream of the turn roller 10*a* here remains $V_S$, whereas the speed $V_t$ of the foil web between the turn rollers 9*b* and 10*a* is higher, depending on the tilting speed, about which more below.

It can clearly be seen that the speed of the foil web upstream of the turn roller 9*a* as well as downstream of the turn roller 10*b* can remain constant.

It can be advantageous for the uniformity of the process to utilise the periods in between the sealing periods entirely for the return tilting in the direction H.

By means of the servo motor 15 the motion of the lever 11—particularly in the direction H—can be accurately controlled, a sinusoidal motion being possible, the motion of the lever 11 taking place as smooth as possible, and acceleration/deceleration forces and sudden stop and starting forces exerted on the foil web material being avoided as much as possible.

It is possible to drive the servo motor 15 only in the direction H, and, to let the motion of the lever 11 take place in the direction G through tensile force exerted on the foil web F by the driving belts, the servo motor then being put in idle position, and the brake being active.

However, it is also possible to control the drive of the lever 11 such that the web speed prior to activating the foil web brake is reduced to an—almost uniform—speed which is lower than $V_S$. In this way the accuracy in the location of braking and thus also in the location of applying the zipper strip is further increased, whereas furthermore the tension in the track between the brake and the sealing head during braking remains better controllable, as a result of which stretch and the effects thereof remain limited. This can take place when a sufficiently large buffer length is available, by already prior to braking the foil web rotating the lever 11 in direction G. The servo motor is particularly suitable for realising such particular controls of the buffer lever 11.

When the loop at the downstream side is large enough for the sealing time and foil speed in question the lever 11 can be kept still in a less far tilted position—for instance in a horizontal position—by such activation of the servo motor 15 that is supplies sufficient torque for keeping the lever still in that position. The foil web F then runs further, via turn rollers 14*a*, 14*b*. This can also be done when no zipper strips at all have to be applied. The foil web F then runs along about the turn rollers 14*a,b* and along the inactive sealing head 16. Further measures then are not necessary for that conversion in type of bag closure.

With the device according to the invention very high speeds, for instance 100 bags per minute, can be achieved, the bags nonetheless being accurately provided with zipper strips at the wanted location, without the application of zipper strips forming too large a hindrance to the speed of the machine.

What is claimed is:

1. A form-fill-seal device for forming bags from a web-shaped foil material, filling them with products and subsequently sealing them, the device comprising a foil supply station having means for holding a roll of foil web, a form shoulder for transforming the foil web into a foil tube and a station placed between the supply station and the form shoulder for applying a zipper strip transverse to the foil web for each bag to be made, the foil web following a first transport track between the supply station and the application station and a second transport track between the application station and the form shoulder, respectively, the device comprising means for continuously driving the foil web, the device further comprising means for forming a buffer length of foil web, which buffer means comprise first foil web diversion means and second foil web diversion means, which engage onto the first and second track of the foil web respectively, and are connected to each other for simultaneous but opposite movement by buffer drive means towards the first track and away from the second track, respectively, and vice versa, while taking up and discharging, respectively, equal lengths of foil web.

2. The device according to claim 1, the first and second foil web diversion means being adapted for performing opposite movements of equal length.

3. The device according to claim 1, the first and second foil web diversion means being adapted for performing opposite movements perpendicular to the direction of travel of the foil web where the web passes the application station.

4. The device according to claim 1, the first and second foil web diversion means being arranged on respective arms of a lever, the buffer drive means engaging on the lever for reciprocally tilting it about a tilting shaft.

5. The device according to claim 4, both levers arms being of equal length.

6. The device according to claim 4, the lever being fixedly arranged on the tilting shaft and the tilting shaft being driven.

7. The device according to claim 6, the drive means comprising a servo motor for driving the tilting shaft.

8. The device according to claim 7, further provided with means for adjusting the torque of the servo motor, preferably related to different stages of a process cycle.

9. The device according to claim 1, a foil web brake being arranged between the first foil web diversion means and the application station for keeping the foil web still between the first and the second foil web diversion means during the operation of the application station.

10. The device according to claim 1, a foil web brake being placed in the first track, between the first foil diversion means and the application station, for keeping the foil web still at the location of the application station during the application of a zipper strip.

11. A form-fill-seal device for forming bags from a web-shaped foil material, filling them with products and subsequently sealing them, the device comprising a foil supply station having means for holding a roll of foil web, a form shoulder for transforming the foil web into a foil tube and a station placed between the supply station and the form shoulder for applying a zipper strip transverse to the foil web for each bag to be made, the foil web following a first transport track between the supply station and the application station and a second transport track between the application station and the form shoulder, respectively, the device comprising means for continuously driving the foil web, the device futher comprising means for forming a buffer length of foil web, which buffer means comprise first foil web diversion means and second foil web diversion means, which engage onto the first and second track of the foil web respectively, and are connected to each other for simultaneous but opposite movement by buffer drive means towards the first track and away from the second track, respectively, and vice versa, while taking up and discharging, respectively, equal lengths of foil web, the first and second foil web diversion means being adapted for performing opposite movements perpenicular to the direction of travel of the foil web where the web passes the application station.

12. The device according to claim 11, the first and second foil web diversion means being adapted for performing opposite movements of equal length.

* * * * *